US006549102B2

(12) United States Patent
Mansour et al.

(10) Patent No.: US 6,549,102 B2
(45) Date of Patent: Apr. 15, 2003

(54) QUASI DUAL-MODE RESONATOR

(75) Inventors: Raafat R. Mansour, Waterloo (CA); Van Dokas, Cambridge (CA); Soeren F. Peik, Waterloo (CA)

(73) Assignee: COM DEV Limited (CA)

( * ) Notice: Subject to any disclaimer, the term of this patent is extended or adjusted under 35 U.S.C. 154(b) by 0 days.

(21) Appl. No.: 10/161,366

(22) Filed: Jun. 3, 2002

(65) Prior Publication Data

US 2002/0149449 A1 Oct. 17, 2002

Related U.S. Application Data

(63) Continuation of application No. PCT/CA00/01453, filed on Dec. 5, 2000.
(60) Provisional application No. 60/169,078, filed on Dec. 6, 1999.

(51) Int. Cl.[7] ..... H01P 7/10
(52) U.S. Cl. ..... 333/219.1; 333/202
(58) Field of Search ..... 333/202, 212, 333/219, 219.1; 331/96

(56) References Cited

U.S. PATENT DOCUMENTS 4,423,397 A * 12/1983 Nishikawa et al. ..... 333/202
4,821,006 A * 4/1989 Ishikawa et al. ..... 333/202
5,057,804 A * 10/1991 Sogo et al. ..... 333/202
5,164,691 A * 11/1992 Wakino et al. ..... 333/219.1
5,990,765 A 11/1999 Mansour et al.
6,255,919 B1 * 7/2001 Smith ..... 333/219.1

FOREIGN PATENT DOCUMENTS

| | | | | |
|---|---|---|---|---|
| DE | 210433 | | 8/1972 | |
| GB | 2239988 | | 7/1991 | |
| JP | 02021103 A | * | 1/1991 | ..... 333/219.1 |
| SU | 1259370 A1 | * | 9/1986 | ..... 333/202 |

* cited by examiner

*Primary Examiner*—Seungsook Ham
(74) *Attorney, Agent, or Firm*—Jones Day

(57) ABSTRACT

A dielectric resonator is provided having a cavity, a dielectric half disk resonator structure structure, and a support for the half disk resonator structure. The support isolates the dielectric half disk resonator structure from walls of the cavity. A straight edge wall of the dielectric half disk resonator structure couples to a dielectric/air interface within the cavity and forms an approximate magnetic wall. The approximate magnetic wall images the electric field perpendicular to the straight edge wall and supports a single-mode electric field within the half disk resonator structure. Multiple half disk resonator structures may be oriented within the cavity to support other, orthogonal electric fields. Multiple cavities may be coupled to each other through irises formed on the cavity walls.

11 Claims, 8 Drawing Sheets

QUASI DUAL-MODE RESONATOR

CROSS-REFERENCE TO RELATED APPLICATIONS

This application is a continuation of co-pending PCT Application No. PCT/CA00/01453, filed Dec. 5, 2000, which claims priority to U.S. Provisional Patent Application No. 60/169,078, filed Dec. 6, 1999.

FIELD OF THE INVENTION

The present invention relates to microwave resonators and filters. More specifically, the invention relates to single multi-mode dielectric or cavity resonators.

BACKGROUND

A microwave resonator is a device that resonates an electromagnetic field. The size and shape of the resonator specify a particular frequency at which the resonator resonates electrical and magnetic signals. This resonance at the particular frequency is achieved by the periodic exchange of energy between the electric and magnetic fields that support the electric and magnetic signals that pass through the resonator. The lowest frequency that resonates within the rsonator is the fundamental mode of the resonator and is generally the frequency of interest in a resonator application. Higher order modes, or spurious modes, may interfere with the fundamental mode. Thus, it is desirable to filter such modes from the electromagnetic signals by filtering the signals outside the fundamental mode frequency.

Single resonators are used most often for frequency meters and frequency standards. A plurality of single resonators can be cascaded to form a microwave filter. An individual resonator in a cascading filter design is electromagnetically coupled to another resonator through a small aperture or a wire. Generally, the resultant filter is a band pass filter that passes the pass-band frequencies. Resonators can be built where the shape of the resonator supports multiple modes. Adjacent resonators may be linearly coupled to form a filter, or alternatively, non-adjacent resonators may be coupled to form quasi-elliptical filters.

A dielectric single-mode resonator 2 from the prior art is shown in FIG. 1. In this known structure, a cylindrical disc 4 is mounted on a support 6 in a housing 8. Inside the disc 4, a magnetic field and an electric field is excited. The resonator 2 stores electric and magnetic energy within the housing 8. Resonance is achieved by the periodic exchange of energy between the electric and magnetic fields. This resonator configuration, however, supports only one particular field pattern 10 in the disc 4 at a particular resonant frequency. In addition, this structure is also relatively large.

FIGS. 2A–2D are views of a dielectric dual-mode resonator also known in the prior art. As shown in FIG. 2, a simiiar structure acting as a dual-mode resonator 12 may support two different electric and magnetic field patterns 14 and 16. The two modes are orthogonal, and thus do not exchange energy between the modes. The two modes may be coupled to each other by including a small disturbance to break the symmetry of the fields. Such a disturbance may be created by a tuning screw 18. This type of resonator may increase the spurious rejection of unwanted frequencies, but is still large.

FIGS. 3A–3C are views of a dielectric single-mode resonator using an electric wall, and is also known in the prior art. This single-mode dielectric resonator 22 resonates a frequency within a half disc 24. The dielectric half disc 24 is mounted on an electric conducting wall 26. The electric conducting wall electromagnetically images another half of the resonator just as an optical mirror images an optical figure. This resonator 22 reduces the resonator size to about half of the dielectric single-mode resonator of FIG. 1. There is, however, only one mode supported within the smaller dielectric filter 22, which has an electric field 28 perpendicular to the electric wall 26. The electric wall must be made of a lossy conductor and thus increases the energy loss within the resonator 22.

SUMMARY

A dielectric resonator is provided having a cavity, a dielectric half disk resonator structure, and a support for the half disk resonator structure. The support isolates the dielectric half disk resonator structure from walls of the cavity. A straight edge wall of the dielectric half disk resonator structure couples to a dielectric/air interface within the cavity and forms an approximate magnetic wall. The approximate magnetic wall images the electric field perpendicular to the straight edge wall and supports a single-mode electric field within the half disk resonator structure. Multiple half disk resonator structures may be oriented within the cavity to support other, orthogonal electric fields. Multiple cavities may be coupled to each other through irises formed on the cavity walls.

One aspect of the invention provides a dielectric resonator comprising a cavity housing, a support mounted within the cavity housing, and a dielectric half disk resonator structure. The dielectric half disk resonator structure is mounted on the support and has a straight edge wall. The dielectric half disk resonator structure resonates an electric field perpendicular to the straight edge wall.

Another aspect of the invention provides a dielectric resonator comprising a cavity housing, a support mounted within the cavity housing, and first and second dielectric half disk resonator structures. The first dielectric half disk resonator structure is mounted on the support and has a first straight edge wall. The second dielectric half disk resonator structure has a second straight edge wall such that the second straight edge wall is isolated from the cavity housing. Each of the dielectric half disk resonator structures resonates an electric field.

Yet another aspect of the invention provides a dielectric resonator comprising a plurality of cavities, a cavity wall separating at least two of the cavities, and an iris formed on the cavity wall coupling the two cavities. Each of the cavities has a dielectric half disk resonator structure mounted such that a straight edge wall of the dielectric half disk resonator structure is isolated from the cavity wall.

DETAILED DESCRIPTION OF THE DRAWINGS

Figure 4B:
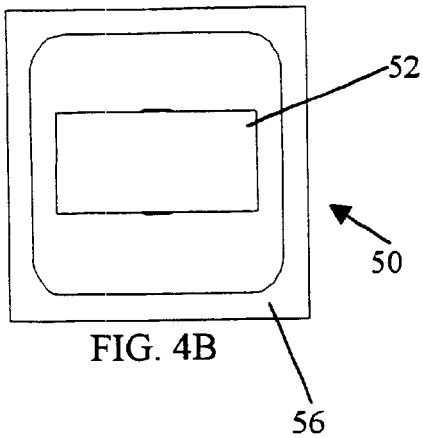
FIGS. 4A–C are views of a dielectric single-mode resonator according to a preferred embodiment of the present invention.
Figure 4A:
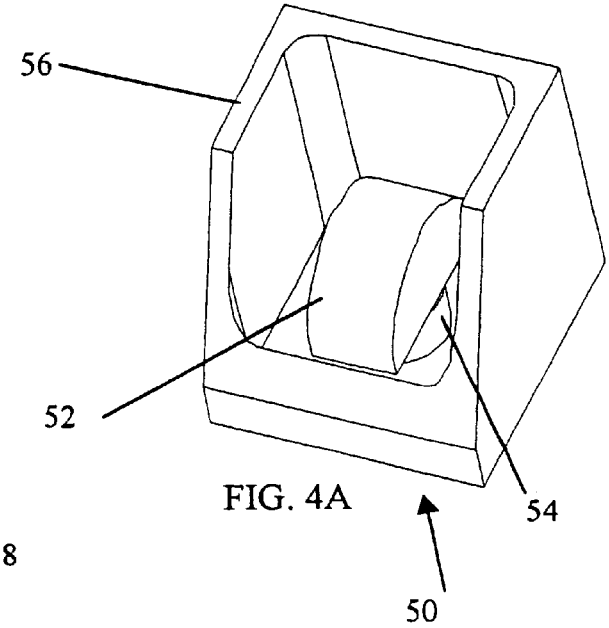
Figure 4C:
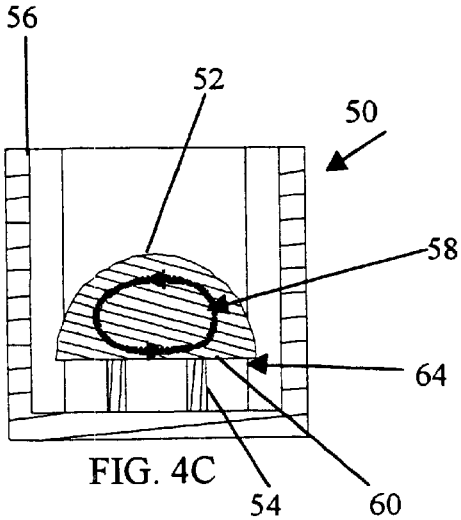

Turning now to the drawing figures that depict various examples of the present invention, FIGS. 4A–C are views of a dielectric single-mode resonator 50. The resonator 50 includes a half disk resonator structure 52 mounted on a support 54 within a cavity housing 56. The support 54 spaces the half disk resonator structure 52 away from the housing 56, and thus spaces the half disk resonator structure 52 away from the electrically conducting walls of the housing 56.

Figure 1B:
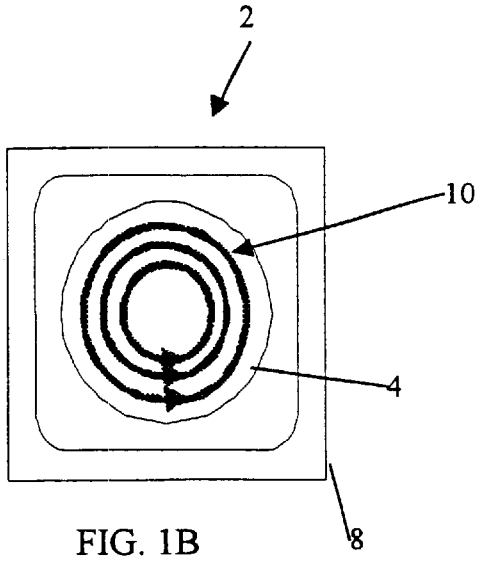
FIGS. 1A–C are views of a dielectric single-mode resonator known in the prior art.
Figure 1A:
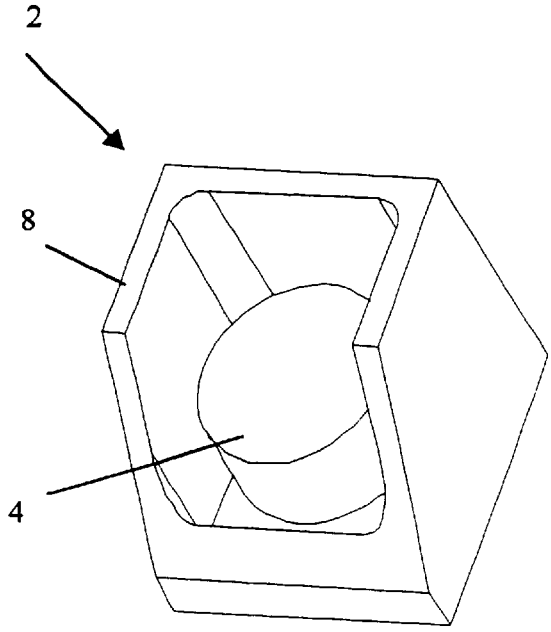
Figure 1C:
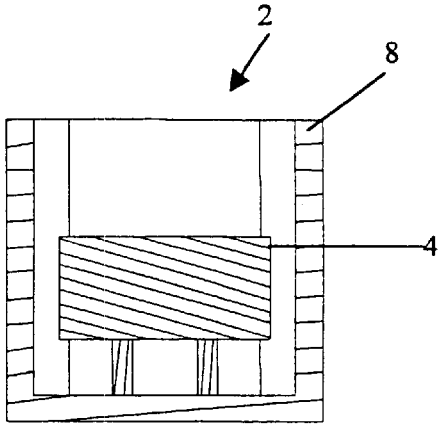
FIG. 1C PRIOR ART
Figures 2B, 2C:
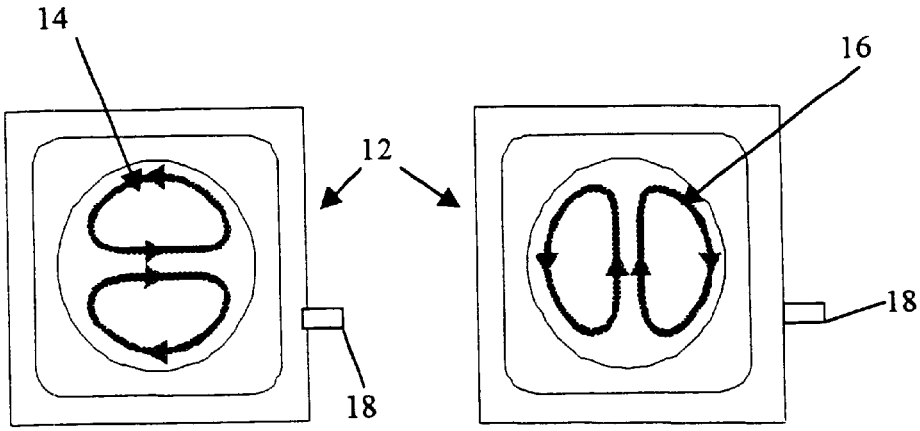
FIGS. 2A–D are views of a dielectric dual-mode resonator also known in the prior art.
Figure 2D:
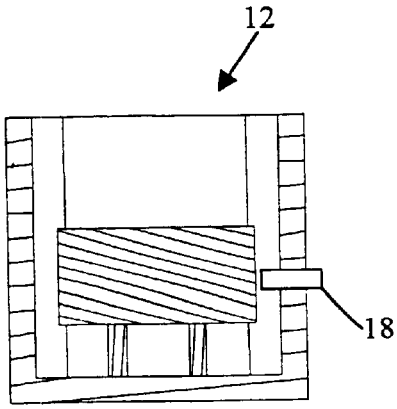
Figure 2A:
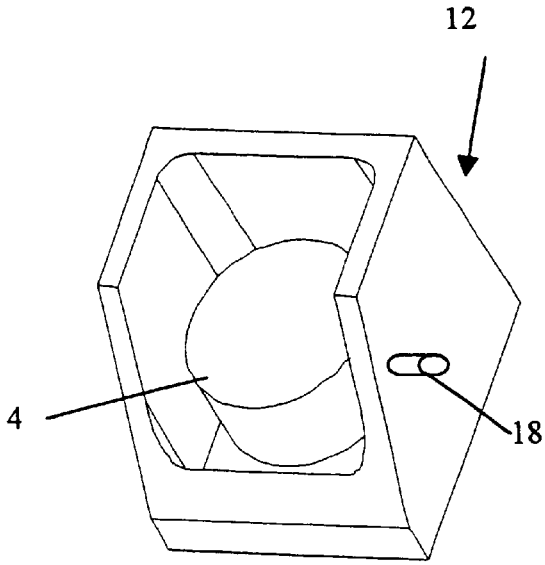
FIG. 2A PRIOR ART

The half disk resonator structure 52 is preferably made of a dielectric material and supports an electric field 58. A flat edge wall 60 of the half disk resonator structure 52 interacts with a dielectric/air interface 64. The dielectric/air interface 64 approximates a magnetic wall for the half disk resonator structure 52 and creates an electromagnetic image of the electric field 58 within the half disk resonator structure 52. The dielectric/air interface 64 thus combines the image of the electric field 58 and the actual electric field 58 within the half disk resonator structure 52 to approximate the properties of the full disk resonator as shown in FIGS. 1 and 2. Because the magnetic wall is only an approximate magnetic wall, and not a true magnetic wall, the resonator deviates from the center frequency with a small frequency shift upward from the center frequency.

Figure 3B:
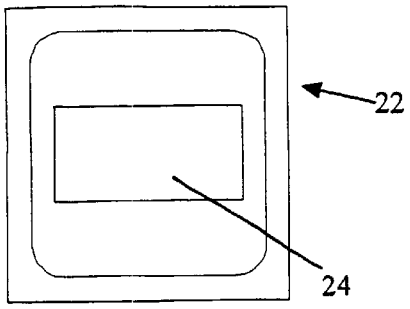
FIGS. 3A–C are views of a dielectric single-mode resonator using an electric wall, and is also known in the prior art.
Figure 3C:
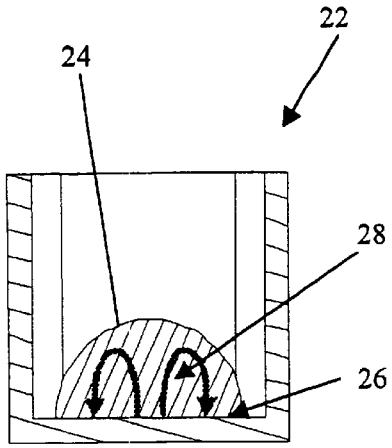
Figure 3A:
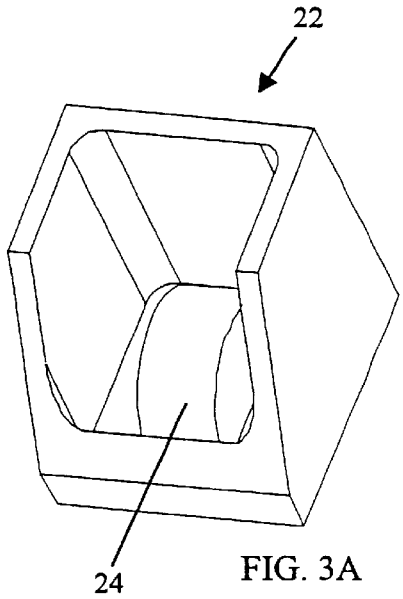
FIG. 3A PRIOR ART

While the half disk resonator structure structure 22 of FIG. 3 uses an approximate electric wall 26 to image the magnetic field of the half disk resonator structure 22, the half disk resonator structure 52 of FIG. 4 uses the dielectric/air interface 64 to form a magnetic wall and to image the electric field parallel to the magnetic wall. The resonator 52 thus does not lose energy through a lossy electric wall. The half disk 52 then can support a single mode within the cavity 56 and retain more energy than a resonator having an approximated electric wall.

Figure 5B:
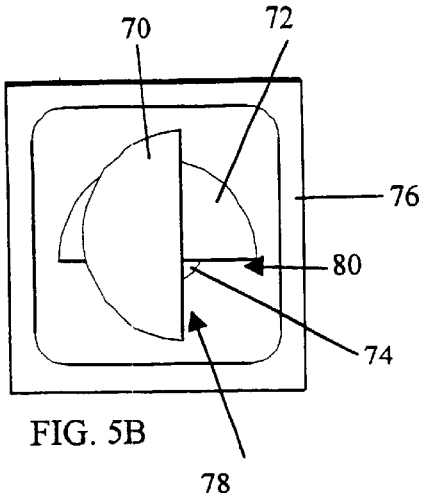
FIGS. 5A–C are views of a dielectric multi-mode resonator according to a preferred embodiment of the present invention.
Figure 5C:
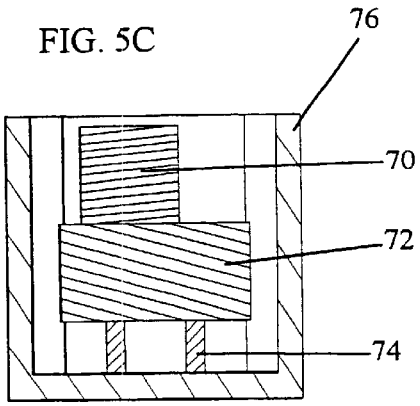
Figure 5A:
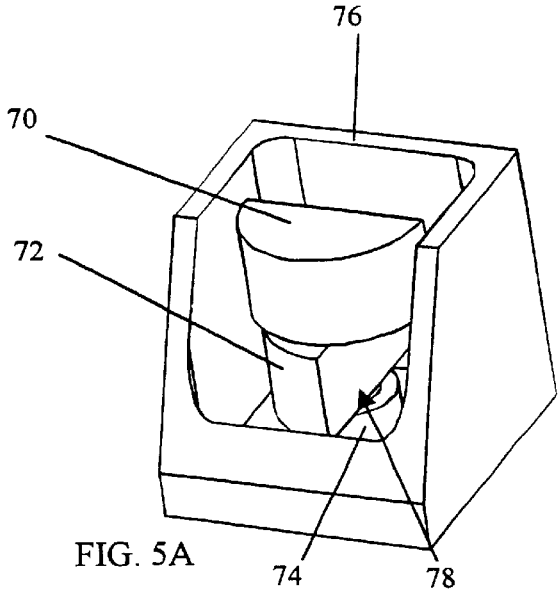

FIGS. 5A–C are views of a dielectric multi-mode resonator according to another embodiment of the present invention. The multi-mode resonator includes first and second half disk resonator structures 70 and 72 mounted on a support 74 within a cavity housing 76. The support 74 spaces the half disks 70 and 72 away from the housing 76, and thus spaces the half disks 70 and 72 away from the electrically conducting walls of the housing 76.

Each half disk 70 and 72 has a dielectric/air interface 78 and 80 forming an approximate magnetic wall. These magnetic walls are oriented orthogonal to each other so that the half disk resonator structures 70 and 72 can then each support one electric field mode. These modes would thus be orthogonally related to each other. The orthogonal modes can be coupled to one another by adjusting the relative positions of the half disk resonator structures 70 and 72 so that adjusting the relative position of the magnetic walls and the overlap of the magnetic walls, the coupling coefficient between the resonators 70 and 72 can be controlled.

Figure 6B:
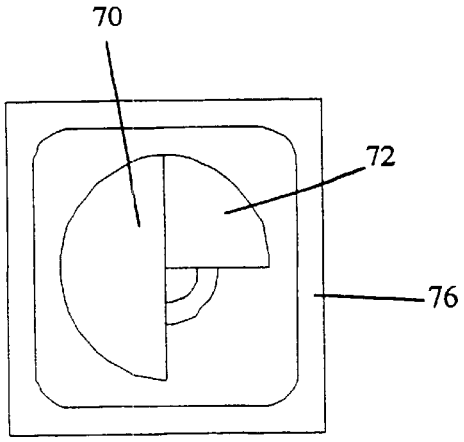
FIGS. 6A–C are views of a dielectric multi-mode resonator according to another preferred embodiment of the present invention.
Figure 6A:
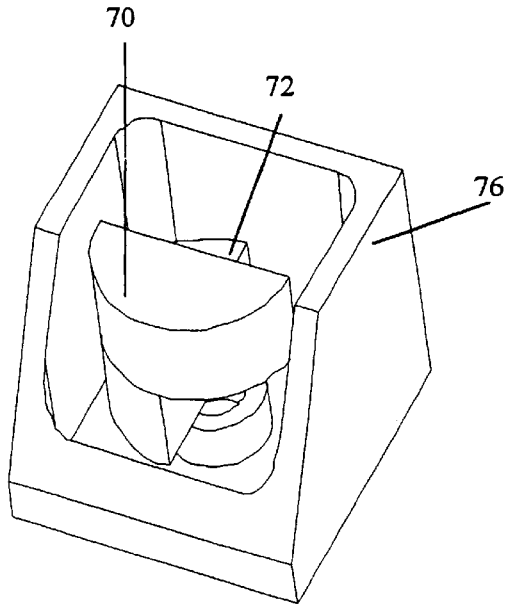
Figure 6C:
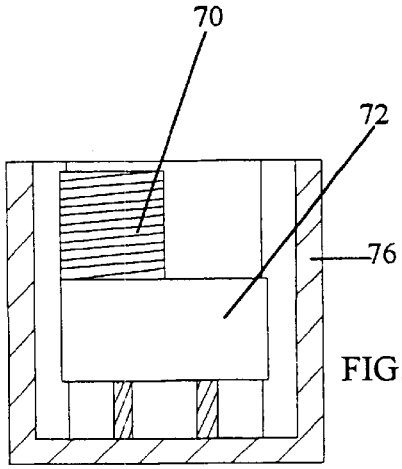
Figure 7B:
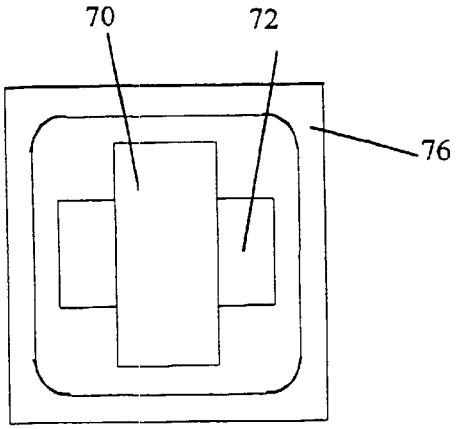
FIGS. 7A–C are views of a dielectric multi-mode resonator according to another preferred embodiment of the present invention.
Figure 7A:
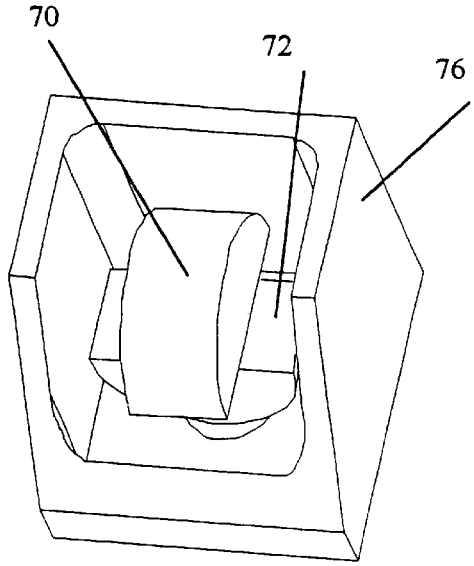
Figure 7C:
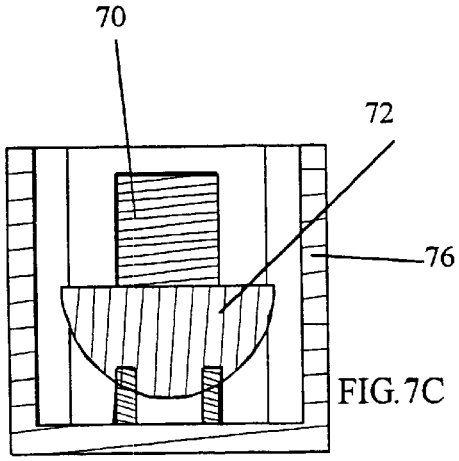

FIGS. 6 and 7 are views of a pair of dielectric multi-mode resonators according to other preferred embodiments of the present invention. With respect to FIG. 5, the pair of half disk resonator structures 70 and 72 in FIGS. 6 and 7 are moved relative to each other, and therefore effect the coupling between the modes that are supported in each resonator. It should be understood that the half disk resonator structures 70 and 72 may be oriented relative to each other in many possible configurations, and that the examples of FIGS. 5–7 are merely representative of some of the possible configurations. Furthermore, it should be understood that more than two half disk resonator structures may be inserted into the housing 76. Each of these multi-mode resonators would act similar to any one resonator in the half disk resonator structures of FIGS. 4 and 5.

Figure 8:
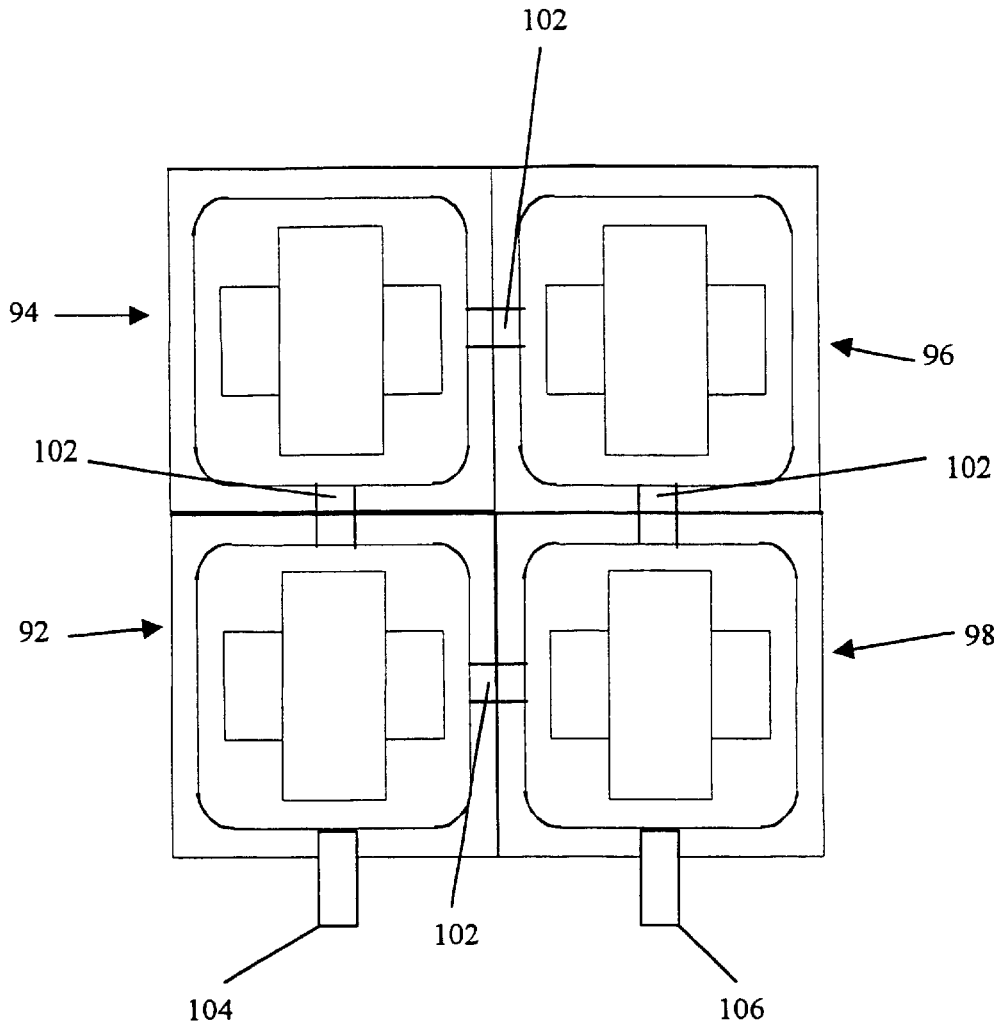
FIG. 8 is an example multi-cavity resonator.

FIG. 8 is an example multi-cavity resonator 90. Cavities 92–98 within the multi-cavity resonator structure 100 are connected through irises 102. The irises 102 couple the modes between the cavities 92–98. An input node 104 inputs an electromagnetic signal into the multi-cavity resonator 90 and an output node 106 retrieves the filtered output signal from the multi-cavity resonator 90. The shape, placement, and size of the irises 102 effect the coupling between modes in the two connected cavities 92–98 that the iris 102 couples. While the irises 102 may be placed between adjacent cavities to form a chain, the coupling may also occur between nonadjacent cavities. Coupling between nonadjacent resonator cavities forms a quasi-elliptical filter function for the resonator.

Having described several examples of the invention by way of the drawing figures, it should be understood that these are just some examples of the invention, and nothing set forth in this detailed description is meant to limit the invention to these examples. Other embodiments, improvements, substitutions, alternatives, or equivalent elements and steps to those set forth in this application are also meant to be within the scope of the invention.

What is claimed is:

1. A dielectric resonator comprising:

a cavity housing;

a support mounted within the cavity housing;

a first dielectric half disk resonator structure mounted on the support and having a straight edge wall with a dielectric/air interface positioned adjacent to the straight edge wall, wherein the straight edge wall and the dielectric/air interface approximate a magnetic wall thereby creating an electromagnetic image of the electric field within the half disk resonator structure.

2. The resonator of claim 1, wherein the straight edge wall is isolated from the cavity housing.

3. The resonator of claim 1, further comprising a second dielectric half disk resonator structure having a straight edge wall such that the straight edge wall of the second dielectric half disk resonator structure is orthogonal to the straight edge wall of the first dielectric half disk, wherein the straight edge wall dielectric/air interface of the second half disk resonator structure approximates a magnetic wall thereby creating an electromagnetic image of the electric field within the second half disk resonator structure.

4. The resonator of claim 3, wherein the straight edge wall of the second dielectric half disk resonator structure is isolated from the cavity housing.

5. The resonator of claim 3, wherein the magnetic wall of the first dielectric half disk resonator structure and the magnetic wall of the second dielectric half disk resonator structure intersect such that the electric fields of the first half disk dielectric resonator structure and the second half disk dielectric resonator structure are coupled.

6. A dielectric resonator, comprising:

a first cavity containing a first dielectric half disk resonator structure, the first half disk resonator structure having a first straight edge wall and a first dielectric/air interface associated with the first straight edge wall;

a second cavity containing a second dielectric half disk resonator structure, the second dielectric half disc resonator structure having a second straight edge wall and a second dielectric/air interface associated with the second straight edge wall;

a cavity wall separating the first cavity from the second cavity; and an iris structure formed on the cavity wall coupling the first cavity to the second cavity, wherein the first dielectric/air interface interacts with the first straight edge wall to approximate a magnetic wall thereby creating an electromagnetic image of the electric field within the first half disk resonator structure and the second dielectric/air interface interacts with the second straight edge wall to approximate a magnetic wall thereby creating an electromagnetic image of the electric field within the second half disk resonator structure.

7. The resonator of claim 6, wherein the straight edge wall of each dielectric half disk resonator structure is isolated from the cavity wall.

8. The resonator of claim 6, wherein the dielectric half disk resonator structure in the first cavity is oriented relative to the cavity wall such that the dielectric half disk resonator structure in the first cavity is an image of the dielectric half disk resonator structure in the second cavity relative to the cavity wall.

9. The resonator of claim 6, wherein each of the plurality of cavities further comprises a second dielectric half disk resonator structure having a straight edge wall such that the straight edge wall of the second dielectric half disk resonator structure is orthogonal to the straight edge wall of the dielectric half disk, wherein the straight edge wall dielectric/air interface of the second half disk resonator structure approximates a magnetic wall thereby creating an electromagnetic image of the electric field within the second half disk resonator structure.

10. The resonator of claim 9, wherein the straight edge wall of the second dielectric half disk resonator structure is isolated from the cavity wall.

11. The resonator of claim 9, wherein the magnetic wall of the dielectric half disk resonator structure and the magnetic wall of the second dielectric half disk resonator structure intersect such that the electric fields of the half disk resonator structure and the second half disk resonator structure are coupled.

* * * * *